US006913411B2

(12) United States Patent
Yamakawa et al.

(10) Patent No.: US 6,913,411 B2
(45) Date of Patent: Jul. 5, 2005

(54) BAND COUPLING STRUCTURE AND METHOD OF MANUFACTURING PIECE MEMBER THEREFOR

(75) Inventors: Jindai Yamakawa, Nishitokyo (JP); Mamoru Sano, Nishitokyo (JP); Hideo Taguchi, Nishitokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 10/276,012

(22) PCT Filed: Mar. 1, 2002

(86) PCT No.: PCT/JP02/01925

§ 371 (c)(1),
(2), (4) Date: Nov. 12, 2002

(87) PCT Pub. No.: WO02/071884

PCT Pub. Date: Sep. 19, 2002

(65) Prior Publication Data

US 2003/0118396 A1 Jun. 26, 2003

(30) Foreign Application Priority Data

Mar. 12, 2001 (JP) ..... 2001-069274

(51) Int. Cl.[7] ..... A44C 5/02

(52) U.S. Cl. ..... 403/154; 403/274; 403/294; 224/164; 224/177; 224/180; 368/282; 72/370.12; 63/9

(58) Field of Search ..... 403/150, 154, 403/274, 294; 224/164, 167, 188, 177, 179, 180; 368/281, 282; 59/78, 79.1, 79.3, 80, 35.1, 13, 15; 72/370.1, 370.11, 370.12; 63/4, 9

(56) References Cited

U.S. PATENT DOCUMENTS 1,275,576 A * 8/1918 Lockwood ..... 403/274 X
3,837,163 A * 9/1974 Fujimori ..... 59/80
4,269,026 A * 5/1981 Bulle et al.
5,038,557 A * 8/1991 Otsuki et al. ..... 59/80
5,197,274 A * 3/1993 Braun ..... 59/80
5,201,171 A * 4/1993 Anderton et al. ..... 59/78 X
6,406,177 B1 * 6/2002 Fukushima et al. ..... 368/282 X
6,408,672 B1 * 6/2002 Roe et al. ..... 72/370.11
6,418,706 B1 * 7/2002 Kit ..... 59/80

FOREIGN PATENT DOCUMENTS

GB 2227155 A * 7/1990 ..... A44C/5/02
JP 4809171 * 2/1973
JP 50-50071 A 5/1975
JP 51-121368 A 10/1976
JP 52022955 A * 2/1977 ..... A44C/5/14

* cited by examiner

*Primary Examiner*—Daniel P. Stodola
*Assistant Examiner*—Ryan M. Flandro
(74) *Attorney, Agent, or Firm*—Webb Ziesenheim Logsdon Orkin & Hanson, P.C.

(57) ABSTRACT

A coupling structure of a watch band in which a coupling member such as a coupling pin or a hair pin does not sup from a coupling hole even if a user practices strenuous sports or a rotation and a twist are always applied to the coupling portion due to use for years, and a method of manufacturing a piece member for the band coupling structure. In a coupling structure of a band comprising a plurality of piece members, a projection protruded in a central direction of a coupling hole from an internal wall of the coupling hole is formed on an outer end of the coupling hole in the piece member positioned on an outside in a transverse direction, and a coupling member is inserted in the coupling hole provided in the transverse direction of the piece member and is engaged with the projection, thereby coupling the piece members to each other.

34 Claims, 16 Drawing Sheets

(A)

(B)

BAND COUPLING STRUCTURE AND METHOD OF MANUFACTURING PIECE MEMBER THEREFOR

BACKGROUND OF THE INVENTION

1. Field of the Invention

The present invention relates to a coupling structure of a band comprising a plurality of piece members such as a band of a wrist watch and to a method of manufacturing the piece member for the coupling structure.

2. Description of the Prior Art

A conventional watch band structure comprises a plurality of piece members that are coupled to each other in a longitudinal direction which can be bent freely in conformity with the shape of a user's arm (see Japanese Laid-Open Utility Model Publications Nos. Sho 50(1975)-50071 and Sho 51(1976)-121368).

In a coupling structure 100 of a watch band, for example, depicted in FIGS. 15 and 16, coupling holes 108 and 110 are formed on coupling ends 104 and 104 on the outside in a transverse direction which are formed on one of the ends of an almost U-shaped piece member 102 and a coupling projection 106 in a central part which is formed on the other end respectively. The coupling projection 106 of one of the piece members 102 is positioned between the coupling ends 104 and 104 of the other piece member 102. Then, an adjust pin 112 energized in a diameter increasing direction, such as a hair pin is inserted as a coupling member in such a state that the coupling holes 108 and 110 of the coupling end 104 and the coupling projection 106 are coincident with each other. Thus, the piece members 102 are coupled to each other in the longitudinal direction in such a manner that the adjust pin 112 does not slip from the coupling holes 108 and 110.

In the case in which the adjust pin energized in the diameter increasing direction, such as the hair pin is used as the coupling member, a coupling pin is removable and the length of a band can be adjusted. In the case in which the coupling pin is used, it is pressed into the coupling hole and is thus fixed unremovably.

In such a coupling structure, however, in the case in which a user practices strenuous sports or a rotation and a twist are always applied to the coupling portion due to use for years, for example, there is a possibility that the coupling member such as the coupling pin 112 might slip from the coupling holes 108 and 110.

Depending on processing precision of the coupling holes 108 and 110 or processing precision of the coupling member such as the coupling pin 112, moreover, there is a possibility that the coupling member such as the coupling pin 112 might slip from the coupling holes 108 and 110.

Furthermore, there is a possibility that the coupling member itself, such as the coupling pin 112, might corrode or might repetitively receive a stress to be broken or to lose elastic force thereof and might thus slip off.

In the case in which the coupling member is thus broken or slips off, the band slips from the user's arm, which is not preferable.

In consideration of the circumstances, it is an object of the present invention to provide a band coupling structure in which a coupling member such as a coupling pin or a hair pin does not slip from a coupling hole even if a user practices strenuous sports or a rotation and a twist are always applied to a coupling portion due to use for years, and to provide a method of manufacturing a piece member for the band coupling structure therefor.

Moreover, it is another object of the present invention to provide a band coupling structure in which a spew or the like is not generated around the coupling hole of a piece member and a finished face such as a mirror finished surface, a hairline, a matte finished surface or a concavo-convex pattern is applied thereto, and external quality is enhanced and a high-class impression is given, and to provide a method of manufacturing the piece member for the band coupling structure therefor.

SUMMARY OF THE INVENTION

The present invention has been made in order to solve the problems and to achieve the objects in the prior art described above, and provides a coupling structure of a band comprising a plurality of piece members, wherein a projection protruded in a central direction of a coupling hole from an internal wall of the coupling hole is formed on an outer end of the coupling hole in the piece member positioned on an outside in a transverse direction, and a coupling member is inserted in the coupling hole provided in the transverse direction of the piece member and is engaged with the projection, thereby coupling the piece members to each other.

Moreover, the present invention provides a method of manufacturing a piece member to be used for a coupling structure of a band comprising a plurality of piece members, wherein a punch member is pressed against an outer end of a coupling hole in the piece member positioned on an outside in a transverse direction, thereby forming a projection protruded in a central direction of the coupling hole from an internal wall of the coupling hole.

With such a structure, the projection protruded in the central direction of the coupling hole from the internal wall of the coupling hole is formed on the outer end of the coupling hole of the piece member which is positioned on the outside in the transverse direction. When the coupling member is inserted and attached into the coupling hole, therefore, the coupling member is engaged with the projection. Consequently, it is possible to reliably prevent the coupling member from slipping out of the coupling hole. In addition, a spew generated by forming the coupling hole is absorbed by the formation of the projection. Consequently, external quality can be enhanced.

In the present invention, moreover, a projection protruded in the central direction of the coupling hole from the internal wall of the coupling hole may be formed on an inner end of the coupling hole in the piece member positioned on the outside in the transverse direction.

With such a structure, the coupling member is also engaged with the projection formed on the inner end of the coupling hole in the piece member which is positioned on the outside in the transverse direction. Consequently, it is possible to more reliably prevent the coupling member from slipping out of the coupling hole. In addition, a spew generated by forming the coupling hole is absorbed by the formation of the projection. Therefore, the movements of the piece members in the coupling portion are not inhibited.

In the present invention, furthermore, the projection protruded in the central direction of the coupling hole from the internal wall of the coupling hole may be formed on an outer end of the coupling hole in the piece member positioned on an inside in the transverse direction.

With such a structure, the coupling member is also engaged with the projection formed on the outer end of the coupling hole in the piece member which is positioned on the inside in the transverse direction. Consequently, it is possible to more reliably prevent the coupling member from slipping out of the coupling hole. In addition, a spew generated by forming the coupling hole is absorbed by the formation of the projection. Therefore, the movements of the piece members in the coupling portion are not inhibited.

In this case, it is possible to provide both the projection formed on the inner end of the coupling hole in the piece member which is positioned on the outside in the transverse direction and the projection formed on the outer end of the coupling hole in the piece member which is positioned on the inside in the transverse direction. Consequently, it is possible to more enhance the effect of preventing the coupling member from slipping off.

In the present invention, moreover, the projection may be formed over a whole periphery of the internal wall of the coupling hole or may be partially formed on the internal wall of the coupling hole. In the case in which the projection is formed over the whole periphery of the internal wall of the coupling hole, the coupling member can sufficiently resist the force for slipping outward from the coupling hole and the coupling member can be reliably prevented from slipping out of the coupling hole.

In the present invention, furthermore, the projection may be formed on the outer ends at both sides of the coupling hole or may be formed on the outer end at either side of the coupling hole. In the case in which the projection is formed on the outer end at either side of the coupling hole, it can correspond to the case in which the coupling hole is a so-called blind hole.

Moreover, the band coupling structure according to the present invention is characterized in that the projection has an outside wall surface formed to have a taper surface inclined toward an inner central part of the coupling hole.

Furthermore, the method of manufacturing a piece member according to the present invention is characterized in that a tip portion of the punch member is cone-shaped so that the projection has an outside wall surface formed to have a taper surface inclined toward an inner central part of the coupling hole.

Thus, the projection has an outside wall surface formed to have the taper surface inclined toward the inner central part of the coupling hole. Therefore, the coupling member can sufficiently resist the force for slipping outward from the coupling hole, and furthermore, the inclined taper surface is chamfered so that the external quality can be enhanced decoratively.

Furthermore, the band coupling structure is characterized in that the projection has an outside wall surface formed to take a curved shape.

The method of manufacturing a piece member according to the present invention is characterized in that a tip portion of the punch member is cone-shaped so that the projection has an outside wall surface formed to take a curved shape.

With such a structure, the projection has an outside wall surface formed to take a curved shape. Therefore, the coupling member can sufficiently resist the force for slipping outward from the coupling hole, and furthermore, the outside wall surface of the projection formed to take the curved shape is finely chamfered so that the external quality can be enhanced decoratively.

Moreover, the band coupling structure according to the present invention is characterized in that the projection has an outside wall surface formed to be perpendicular to the coupling hole.

The method of manufacturing a piece member according to the present invention is characterized in that a tip portion of the punch member includes a fitting portion for fitting in the coupling hole and a flat portion therearound so that the projection has an outside wall surface formed to be perpendicular to the coupling hole.

Thus, the projection has an outside wall surface formed to be perpendicular to the coupling hole. Consequently, the coupling member can sufficiently resist the force for slipping outward from the coupling hole, and furthermore, the outside wall surface of the projection which is formed flatly is finely chamfered so that the external quality can be enhanced decoratively.

In the present invention, moreover, a crossing angle $\alpha$ formed by the taper surface of the projection is set to range from 90° to 130°, is preferably at least one selected from 90°, 100°, 110°, 120° and 130°, and is more preferably set to 110°.

More specifically, if the crossing angle $\alpha$ formed by the taper surface of the projection is smaller than 90°, the projection is not formed on the internal wall of the coupling hole and the coupling member might slip off, and furthermore, a bulged portion is formed on the outside in the transverse direction of the coupling hole, resulting in a deterioration in the external quality.

To the contrary, if the crossing angle $\alpha$ formed by the taper surface of the projection is greater than 130°, very great force is required for forming the projection so that a workability is deteriorated and the size of a processing apparatus is increased. In addition, it is hard to carry out a centering work for causing the center of a punch member to be coincident with the center of the coupling hole. Consequently, the projection is not uniformly formed around the internal wall of the coupling hole so that the coupling member might slip off and the external quality is deteriorated.

In the present invention, moreover, it is preferable that the projection should be formed by pressing a punch member against the outer end of the coupling hole positioned on the outside in the transverse direction of the piece member by force having an impact load of 5 kgf to 14 kgf. Preferably, the punch member is pressed by at least one force having an impact load selected from 5 kgf, 6 kgf, 7 kgf, 8 kgf, 9 kgf, 10 kgf, 11 kgf, 12 kgf, 13 kgf and 14 kgf, and more preferably, the punch member is pressed by force having an impact load of approximately 8 kgf.

More specifically, if the pressing force of the punch member has a smaller impact load than 5 kgf, it is too small so that the projection is not formed on the internal wall of the coupling hole and the coupling member might slip off. To the contrary, if the pressing force of the punch member has a greater impact load than 14 kgf, the area of the outside wall portion of the projection is increased so that the external quality is deteriorated, and furthermore, a workability becomes poor and the size of a processing apparatus is increased.

Moreover, the present invention is characterized in that the projection is formed by pressing a punch member against the outer end of the coupling hole positioned on the outside in the transverse direction of the piece member by force having an impact load of approximately 8 kgf at a crossing angle $\alpha$ formed by the taper surface of the projection of approximately 110°.

Thus, the coupling member can sufficiently resist the force for slipping outward from the coupling hole, and the taper surface is finely chamfered and the external quality can be greatly enhanced decoratively.

Furthermore, the present invention is characterized in that a surface of a tip portion of the punch member has at least one finished face selected from a mirror finished surface, a hairline, a matte finished surface and a concavo-convex pattern, and the finished face of the surface of the tip portion of the punch member is thereby transferred onto the outside wall surface of the projection so that the outside wall surface of the projection has at least one finished face selected from the mirror finished surface, the hairline, the matte finished surface and the concavo-convex pattern.

Thus, the surface of the tip portion of the punch member has at least one finished face selected from the mirror finished surface, the hairline, the matte finished surface and the concavo-convex pattern. Such a punch member is simply pressed against the outer end of the coupling hole so that the finished face of the surface of the tip portion of the punch member can easily be transferred onto the outside wall surface of the projection. Accordingly, the outside wall surface of the projection can be formed to have at least one finished face selected from the mirror finished surface, the hairline, the matte finished surface and the concavo-convex pattern. Therefore, the taper surface can be finely chamfered. Thus, it is possible to provide a coupling structure of a band in which external quality can be enhanced decoratively and a high-class impression can be given.

In the band coupling structure according to the present invention, moreover, the coupling member is a coupling pin or an adjust pin.

In this case, it is preferable that the coupling pin should be at least one selected from a press-in pin, a hair pin and a pin and split pipe.

Furthermore, it is preferable that the adjust pin should be at least one selected from a hair pin and a pin and split pipe.

DETAILED DESCRIPTION OF THE PREFERRED EMBODIMENTS

An embodiment (example) of the present invention will be described below with reference to the drawings.

Figure 1:
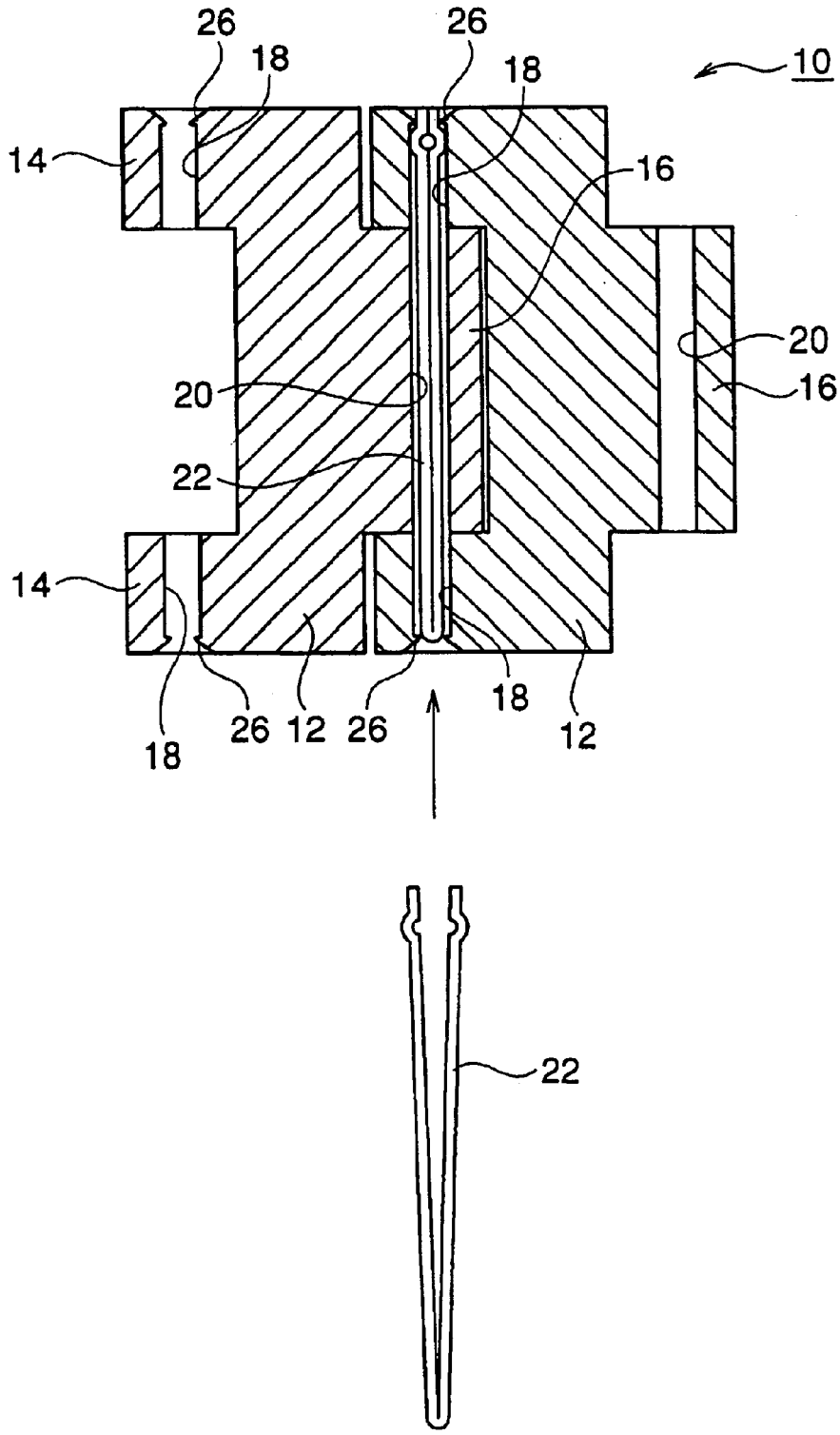
FIG. 1 is a sectional view showing a band coupling portion according to a first embodiment of a band coupling structure in accordance with the present invention.
Figure 2:
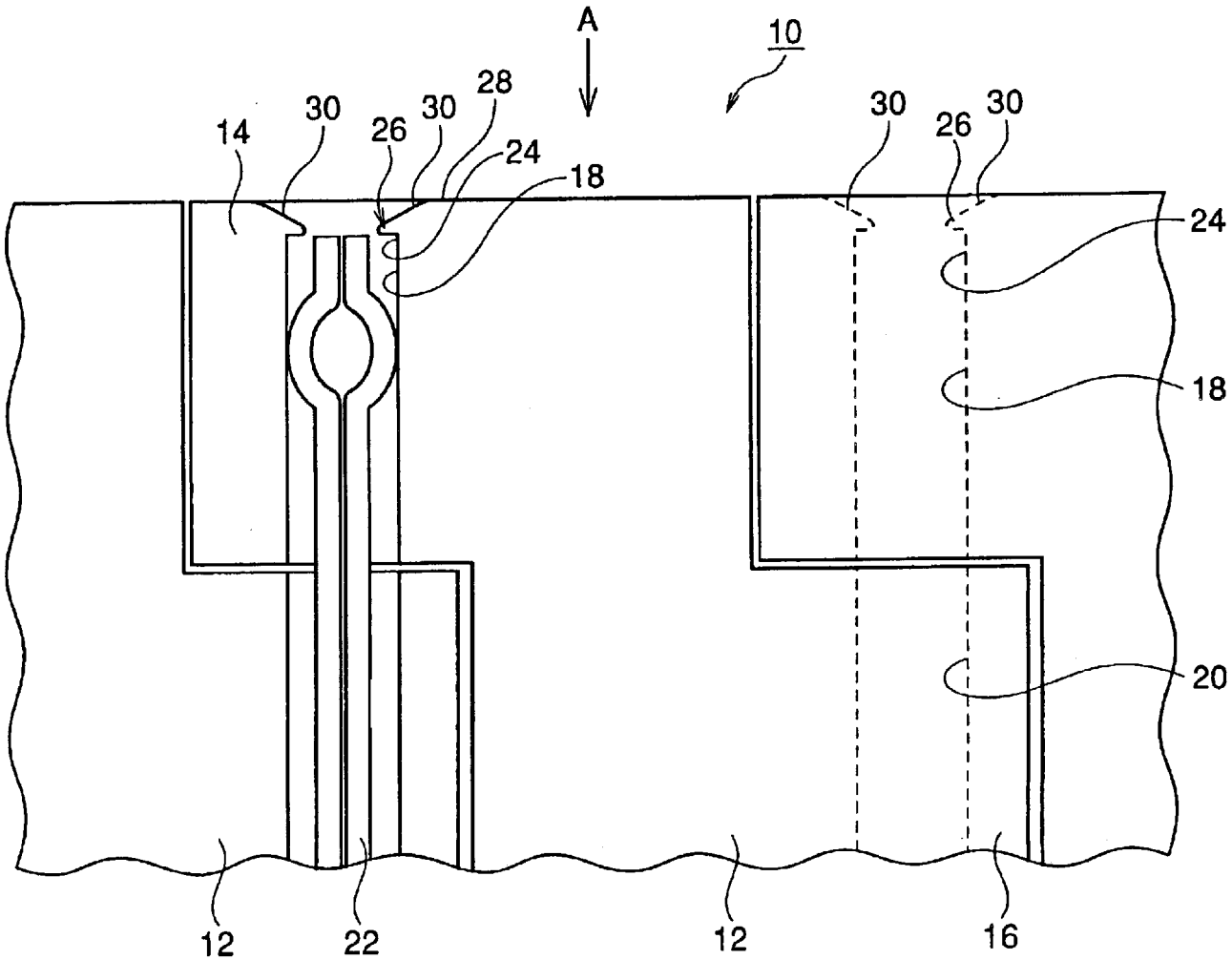
FIG. 2 is a partially enlarged view of FIG. 1.
Figure 3:
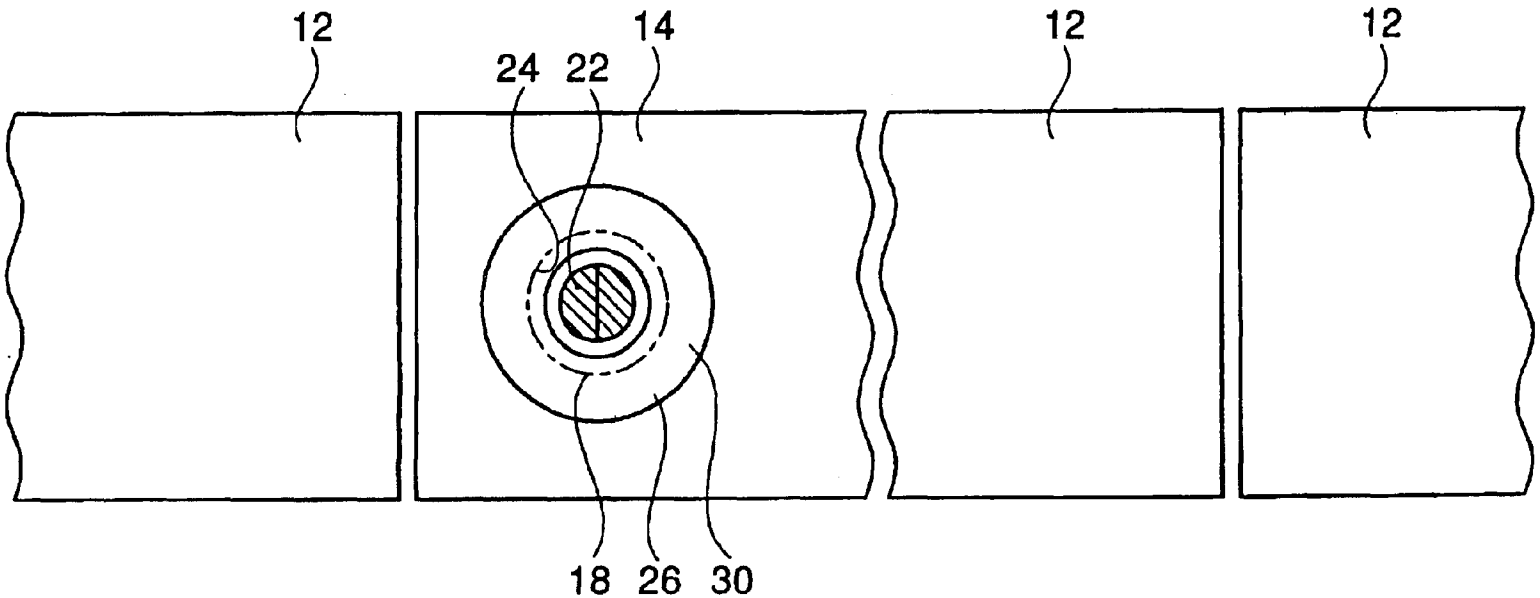
FIG. 3 is an end view in a direction of A in FIG. 2.
Figure 4:
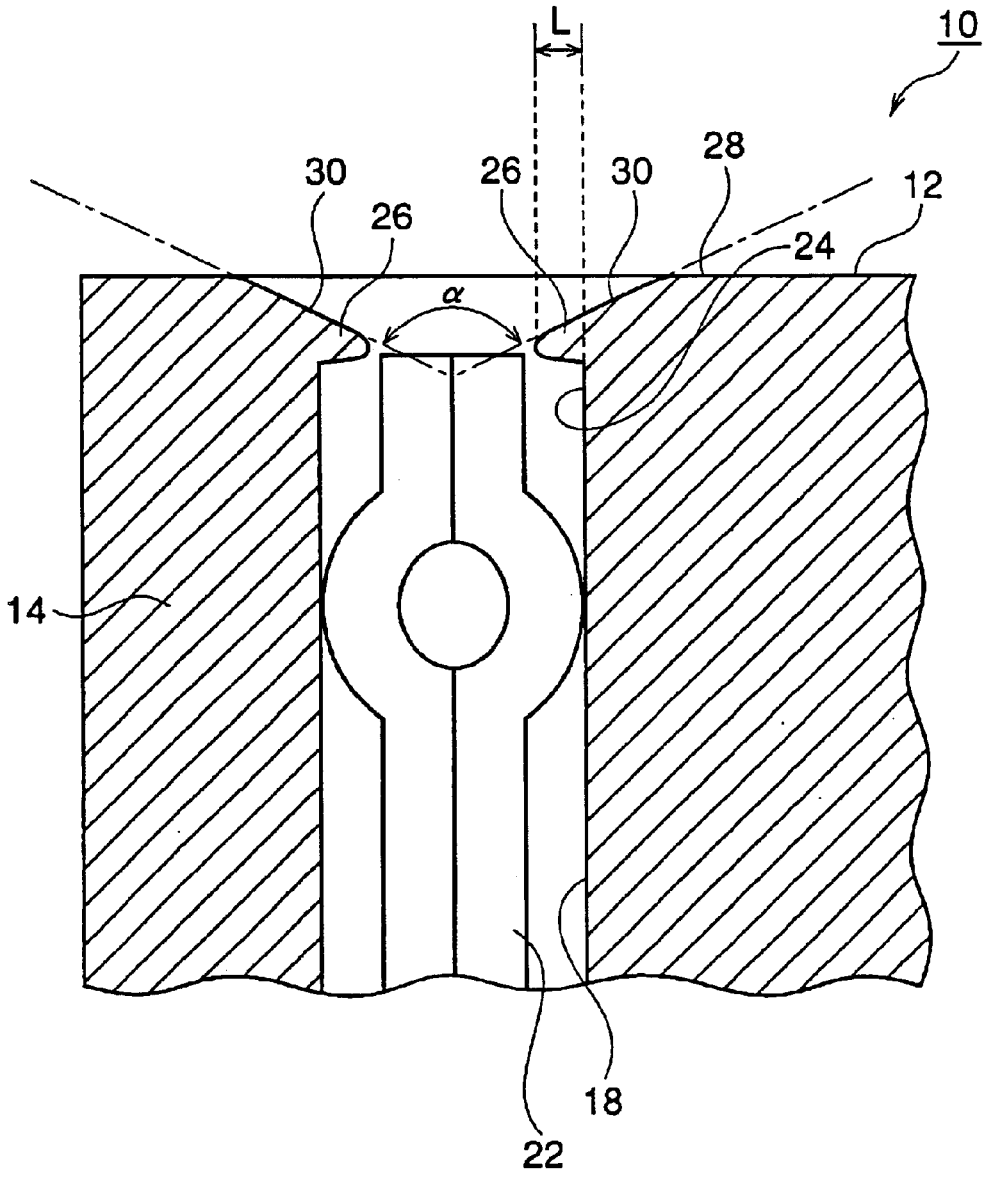
FIG. 4 is a further enlarged sectional view of FIG. 2.
Figure 5:
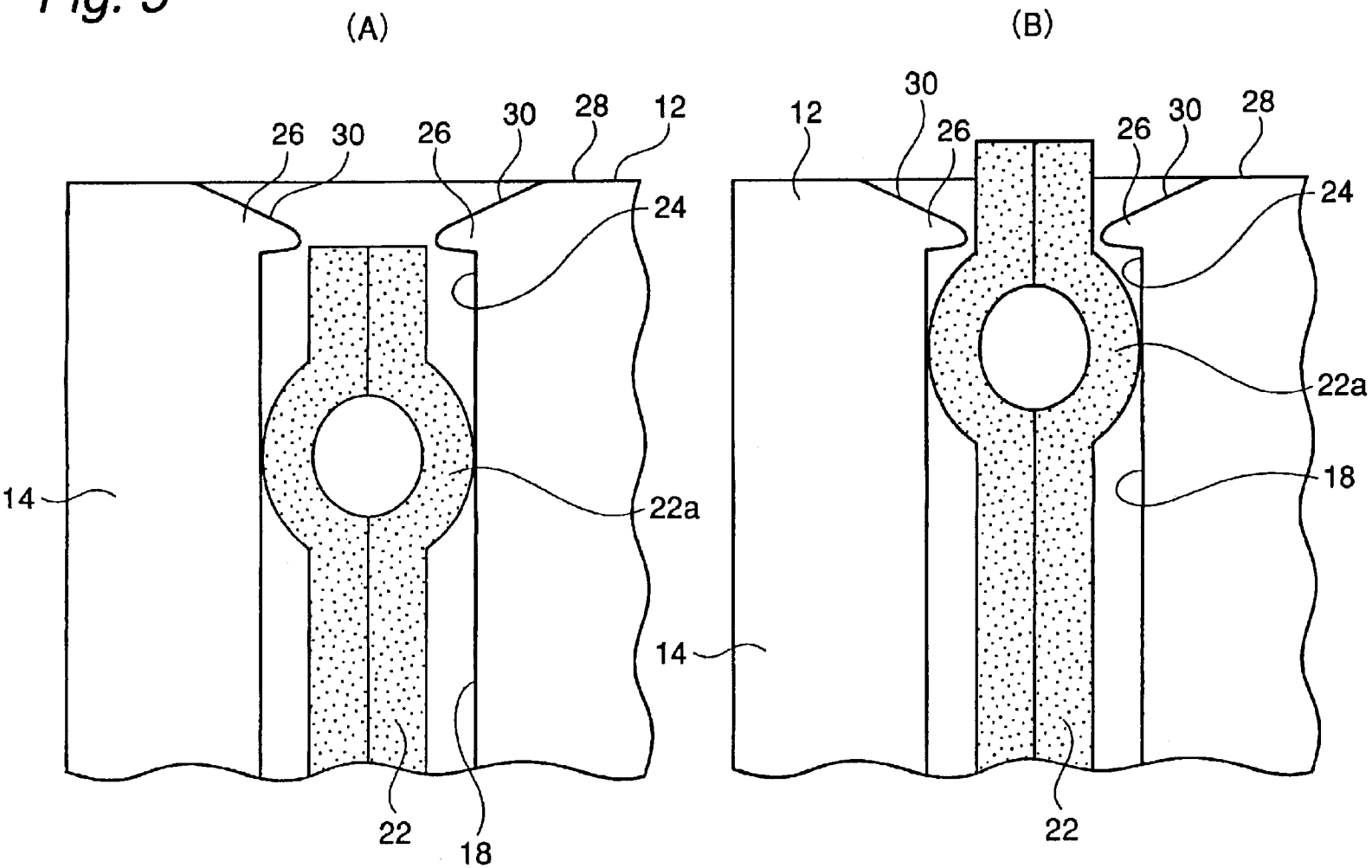
FIG. 5 is a schematic view for explaining the function of the band coupling structure according to the present invention illustrated in FIG. 1.
Figure 6:
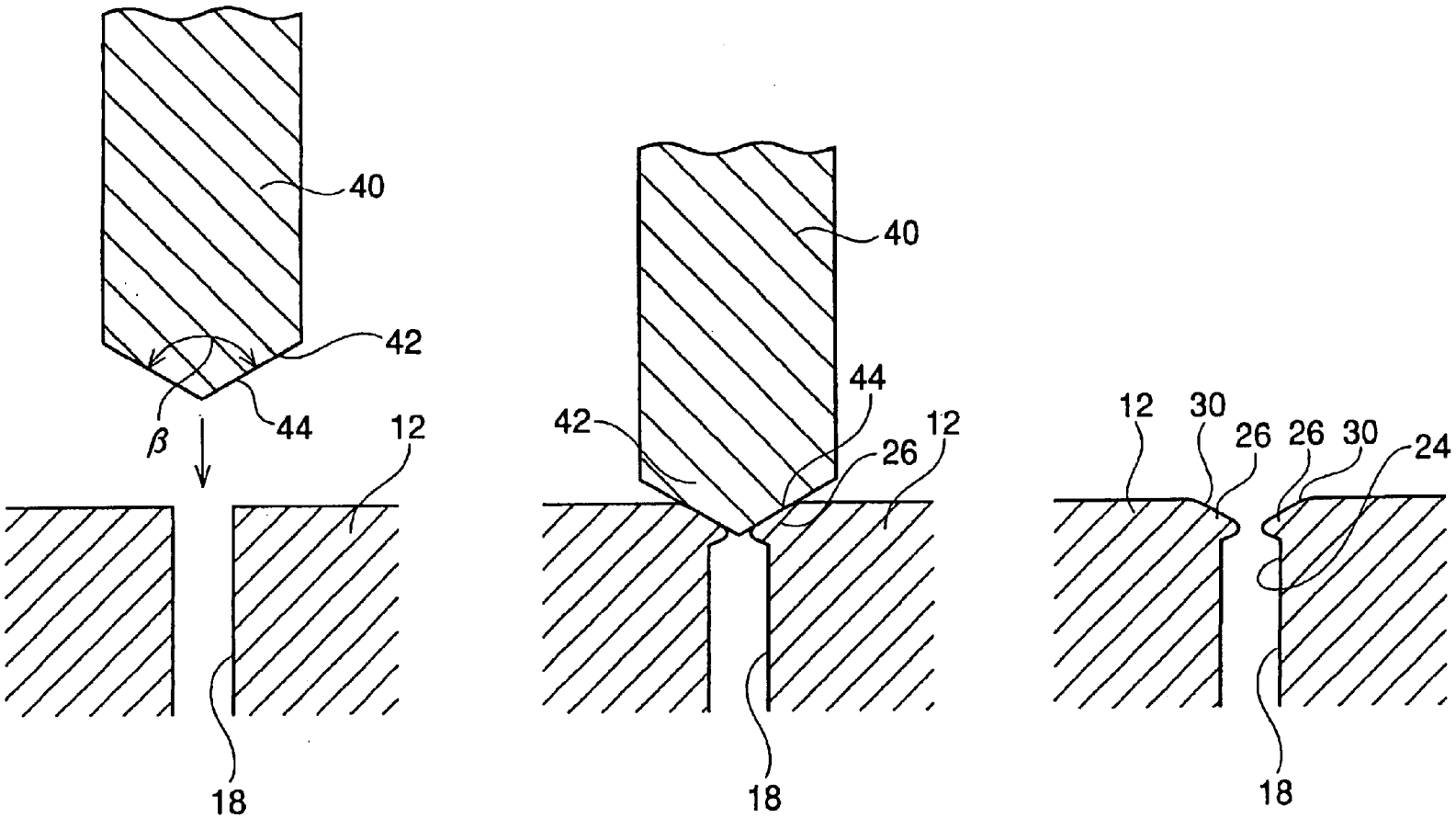
FIG. 6 is a schematic view for explaining a method of manufacturing a piece member of the band coupling structure according to the present invention illustrated in FIG. 1.

FIG. 1 is a sectional view showing a band coupling portion according to a first embodiment of a band coupling structure in accordance with the present invention, FIG. 2 is a partially enlarged view of FIG. 1, FIG. 3 is an end view in a direction of A in FIG. 2, FIG. 4 is a further enlarged sectional view of FIG. 2, FIG. 5 is a schematic view for explaining the function of the band coupling structure according to the present invention illustrated in FIG. 1, and FIG. 6 is a schematic view for explaining a method of manufacturing a piece member of the band coupling structure according to the present invention illustrated in FIG. 1.

As shown in FIG. 1, a band coupling structure 10 according to the present invention is constituted by rotatably coupling almost U-shaped piece members 12 to each other.

The piece member 12 comprises coupling ends 14 and 14 on the outside in a transverse direction which are formed to be protruded from one of ends, and a coupling projection 16 in a central part which is formed to be protruded from the other end. The coupling end 14 and the coupling projection 16 are provided with coupling holes 18 and 20, respectively.

The coupling projection 16 of one of the piece members 12 is positioned between the coupling ends 14 and 14 of the other piece member 12, and an adjust pin 22 energized in a diameter increasing direction, for example, a hair pin is inserted as a coupling member in such a state that the coupling holes 18 and 20 of the coupling end 14 and the coupling projection 16 are coincident with each other. Thus, the piece members 12 are coupled to each other in a longitudinal direction such that the adjust pin 22 does not slip from the coupling holes 18 and 20.

In this case, in the band coupling structure 10 according to the present invention as shown in FIGS. 2 and 4, in order to prevent the adjust pin 22 to be the coupling member from slipping out of the coupling holes 18 and 20, for example, when a user practices strenuous sports or a rotation and a twist are always applied due to use for years, a projection 26 protruded in the central direction of the coupling hole 18 from an internal wall 24 of the coupling hole 18 is formed. This projection is formed on the outer end of the coupling hole 18 in the piece member 12 positioned on the outside in a transverse direction.

Consequently, the adjust pin 22 to be the coupling member is inserted in the coupling hole 18 provided in the transverse direction of the piece member 12 and is thus engaged with the projection 26, so that the piece members 12 are rotatably coupled to each other.

By such a structure, when the adjust pin 22 to be the coupling member is inserted and attached into the coupling hole 18 as shown in FIG. 5, a bulged portion 22*a* of the adjust pin 22 abuts on the projection 26 so that the adjust pin 22 is engaged with the projection 26, for example. Therefore, the adjust pin 22 can be reliably prevented from slipping out of the coupling hole 18. In addition, a spew generated by forming the coupling hole 18 is absorbed by the formation of the projection 26. Consequently, external quality can be enhanced.

In this case, the projection 26 has an outside wall surface 28 formed to be a taper surface 30 which is included toward the inner central part of the coupling hole 18 as shown in FIG. 4. Thus, the projection 26 has the outside wall surface 28 formed to be the taper surface 30 which is inclined toward the inner central part of the coupling hole 18. Therefore, the adjust pin 22 to be the coupling member can sufficiently resist the force for slipping outward from the coupling hole 18, and furthermore, the tapered surface 30 which is inclined is chamfered so that the external quality can be enhanced decoratively.

Moreover, a crossing angle α formed by the taper surface 30 of the projection 26 is set to range from 90° to 130°, is preferably at least one selected from 90°, 100°, 110°, 120° and 130°, and is more preferably approximately 110°.

Figure 7:
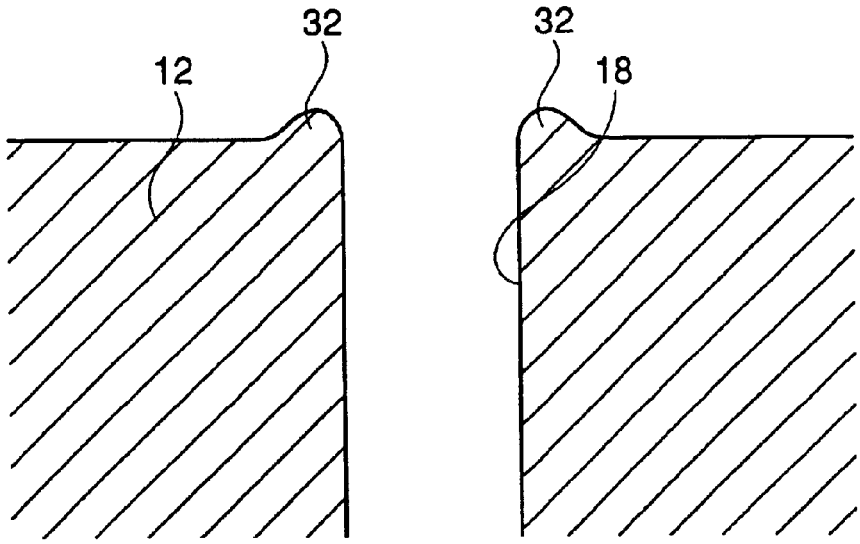
FIG. 7(A) is a partially enlarged sectional view for explaining drawbacks caused by manufacturing the piece member and FIG. 7(B) is a top view showing another embodiment of a projection.
Figure 7:
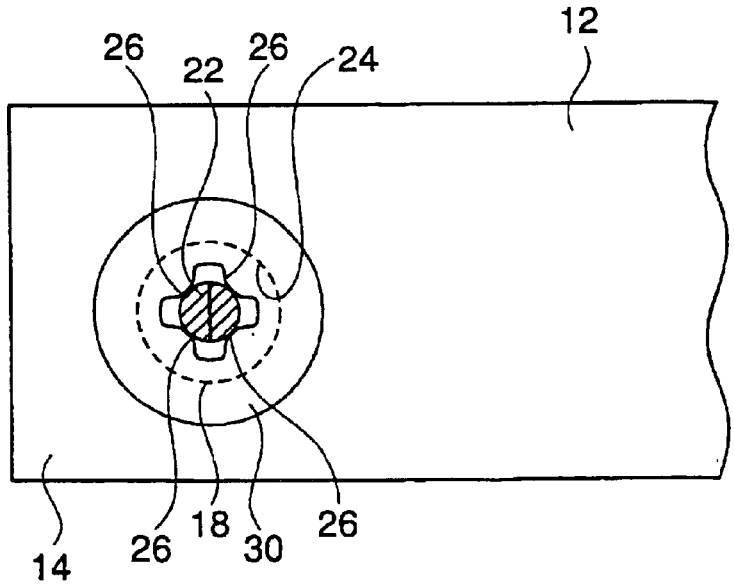

More specifically, if the crossing angle α formed by the taper surface 30 of the projection 26 is smaller than 90°, the projection 26 is not formed on the internal wall 24 of the coupling hole 18 and the adjust pin 22 to be the coupling member might slip off, and furthermore, a bulged portion 32 is formed on the outside in the transverse direction of the coupling hole 18 as shown in FIG. 7(A), resulting in a deterioration in the external quality.

To the contrary, if the crossing angle α formed by the taper surface 30 of the projection 26 is greater than 130°, very great force is required for forming the projection 26 so that a workability is deteriorated and the size of a processing apparatus is increased. In addition, it is hard to carry out a centering work for causing the center of a punch member to be coincident with the center of the coupling hole 18. Consequently, the projection 26 is not uniformly formed around the internal wall 24 of the coupling hole 18 so that the adjust pin 22 to be the coupling member might slip off and the external quality is deteriorated.

In order to form the projection 26 as shown in FIG. 6, it is preferable that a punch member 40 which is constituted to be perpendicularly movable by a driving mechanism (not shown), should be pressed against the outer end of the coupling hole 18 of the piece member 12 positioned on the outside in the transverse direction. As a result, the projection 26 protruded in the central direction of the coupling hole 18 from the internal wall 24 of the coupling hole 18 can be formed.

Moreover, the projection 26 may be formed after the piece member 12 is assembled by the coupling member or when the piece member 12 itself is to be fabricated.

In this case, the surface of a tip portion 42 of the punch member 40 is cone-shaped. It is preferable that an angle β formed by a cone-shaped slant surface 44 should correspond to the crossing angle α formed by the taper surface 30 of the projection 26 provided by pressing the tip portion 42 of the punch member 40. More specifically, the angle β formed by the cone-shaped slant surface 44 ranges from 90° to 130°, is preferably at least one selected from 90°, 100°, 110°, 120° and 130°, and is more preferably approximately 110°.

For the pressing force to press the punch member 40 against the outer end of the coupling hole 18 of the piece member 12 positioned on the outside in the transverse direction, moreover, pressing is carried out by force having an impact load ranging from 5 kgf to 14 kgf, preferably at least one force having an impact load selected from 5 kgf, 6 kgf, 7 kgf, 8 kgf, 9 kgf, 10 kgf, 11 kgf, 12 kgf, 13 kgf and 14 kgf, and more preferably force having an impact load of approximately 8 kgf.

More specifically, if the pressing force of the punch member 40 has a smaller impact load than 5 kgf, it is too small so that the projection 26 is not formed on the internal wall 24 of the coupling hole 18 and the coupling member might slip off. To the contrary, if the pressing force of the punch member 40 has a greater impact load than 14 kgf, the area of the outside wall portion of the projection 26 is increased so that the external quality is deteriorated, and furthermore, a workability becomes poor and the size of a processing apparatus is increased.

In this case, a punch apparatus comprising the punch member 40 is not particularly restricted but a well-known punch apparatus can be employed.

In other words, the punch apparatus comprising the punch member 40 serves to carry out pressing at a static load or pressing at an impact load, which is not particularly restricted. For example, it is possible to employ an autopunch for carrying out pressing at an impact load.

Moreover, the pressing force applied at the impact load is approximately 20 times as much as the pressing force applied at the static load based on a conversion. For example, if the autopunch is used and the impact load is 5 kgf, a static load of approximately 100 kgf is obtained based on the conversion.

Accordingly, it is suitable that the punch member 40 should be pressed against the outer end of the coupling hole 18 of the piece member 12 positioned on the outside in the transverse direction by force having an impact load of approximately 8 kgf at a crossing angle α of approximately 110° which is formed by the taper surface 30 of the projection 26. Thus, the coupling member can sufficiently resist the force for slipping outward from the coupling hole, and the taper surface 30 is finely chamfered and the external quality can also be greatly enhanced decoratively.

As shown in FIG. 4, moreover, a projection distance L of the projection 26 is 10 μm to 100 μm, preferably 30 μm to 70 μm, and more preferably 40 μm to 50 μm depending on the diameter of the coupling hole 18. If the projection distance L is smaller than 10 μm, the coupling pin or the adjust pin 22 to be the coupling member cannot be engaged so that the coupling member might slip from the coupling hole 18. To the contrary, if the projection distance L is greater than 100 μm, it is hard to carry out a work for removing the coupling member from the coupling hole 18 in the case of the adjust pin 22.

Furthermore, the projection 26 may be formed over the whole periphery of the internal wall 24 of the coupling hole 18 as shown in FIG. 3 or may be partially formed over the internal wall 24 of the coupling hole 18 as shown in FIG. 7(B). In the case in which the projection 26 is formed over the whole periphery of the internal wall of the coupling hole, the coupling member can sufficiently resist the force for slipping outward from the coupling hole and the coupling member can be reliably prevented from slipping out of the coupling hole.

Moreover, the projection 26 may be formed on the outer ends at both sides of the coupling hole 18 or may be formed on the outer end at either side of the coupling hole 18. The projection 26 formed on the outer end at either side of the coupling hole 18 can correspond to the case in which the coupling hole 18 is a so-called blind hole. The coupling hole of a watch band has a general diameter of 800 μmϕ to 1300 μmϕ every 100 μm.

Furthermore, the surface of the tip portion 42 of the punch member 40 may have at least one finished face selected from a mirror finished surface, a hairline, a matte finished surface (honing) and a concavo-convex pattern. Consequently, the finished face of the surface of the tip portion 42 of the punch member 40 is transferred onto the outside wall surface 28 of the projection 26 so that the outside wall surface 28 of the projection 26 has at least one finished face selected from the mirror finished surface, the hairline, the matte finished surface (honing) and the concavo-convex pattern.

Thus, the punch member 40 including the surface of the tip portion 42 having at least one finished face selected from the mirror finished surface, the hairline, the matte finished surface and the concavo-convex pattern is simply pressed against the outer end of the coupling hole 18, so that the finished face of the surface of the tip portion 42 of the punch member 40 can be easily transferred onto the outside wall surface 28 of the projection 26.

Accordingly, the outside wall surface 28 of the projection 26 can be formed to have at least one finished face selected from the mirror finished surface, the hairline, the matte finished surface (honing) and the concave-convex pattern. Consequently, it is possible to provide a band coupling structure in which the taper surface 30 is finely chamfered, external quality is decoratively enhanced and a high-class impression is given.

A processing method of finishing the surface of the tip portion 42 of the punch member 40 to have the mirror finished surface, the hairline, the matte finished surface (honing) or the concavo-convex pattern is not particularly restricted but a well-known processing method can be employed, for example, brushing is carried out for the hairline.

Figure 8:
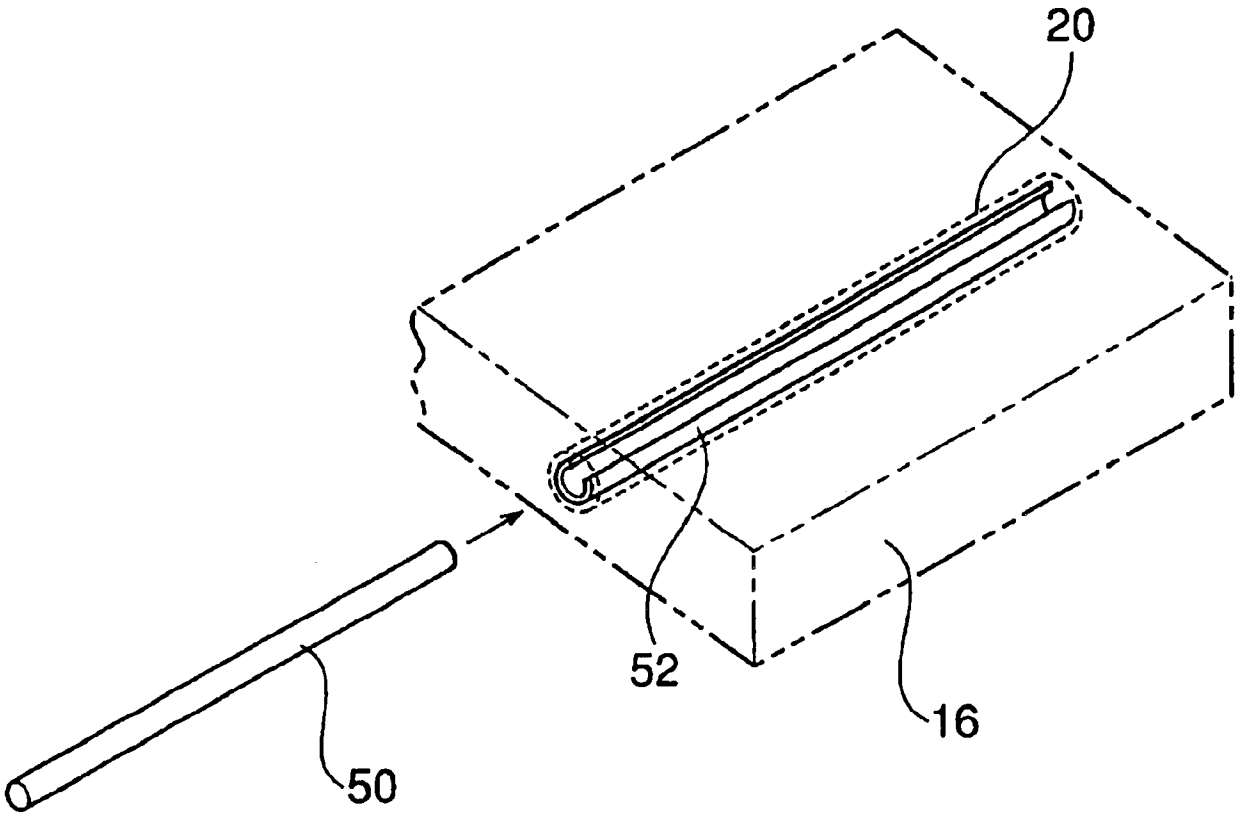
FIG. 8 is a schematic view showing another embodiment of a coupling member to be used in the present invention.

While the adjust pin 22 energized in the diameter increasing direction, such as a hair pin is used as the coupling member in the present embodiment, the adjust pin 22 can further be constituted by a pin 50 and a split pipe 52 as shown in FIG. 8 and can also have such a structure that the split pipe 52 is previously attached to the coupling hole 20 of the coupling projection 16 in the central part of the piece member 12 and the pin 50 is attached and fixed into the split pipe 52.

In the case in which the adjust pin is thus used for the coupling member, the coupling pin is removable and the length of the band can be adjusted.

Furthermore, a coupling pin to be pressed into a coupling hole and fixed unremovably may be used for the coupling member. It is preferable that such a coupling pin should be at least one selected from a press-in pin, a hair pin, and a pin and split pipe.

Figure 9:
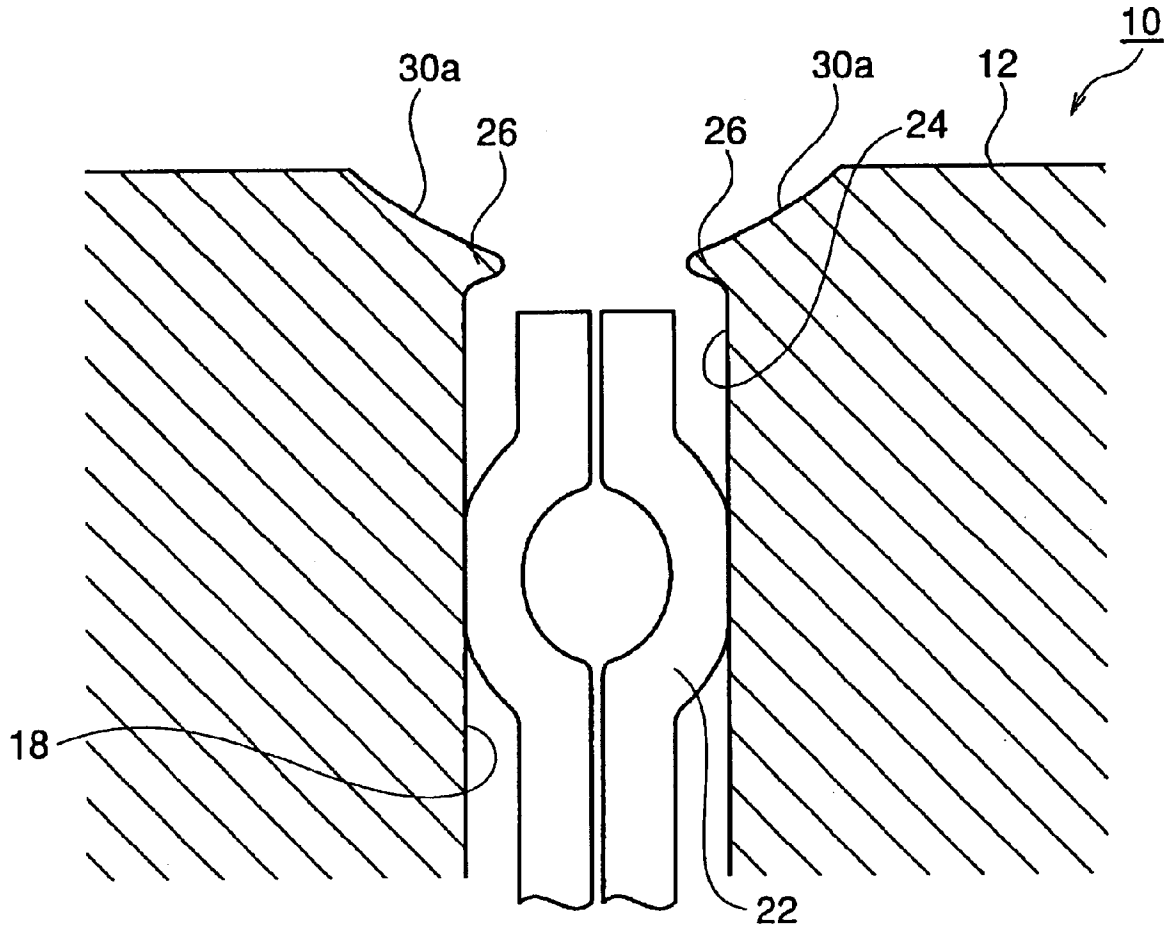
FIG. 9 is a sectional view showing a band coupling portion according to a second embodiment of the band coupling structure in accordance with the present invention.
Figure 10:
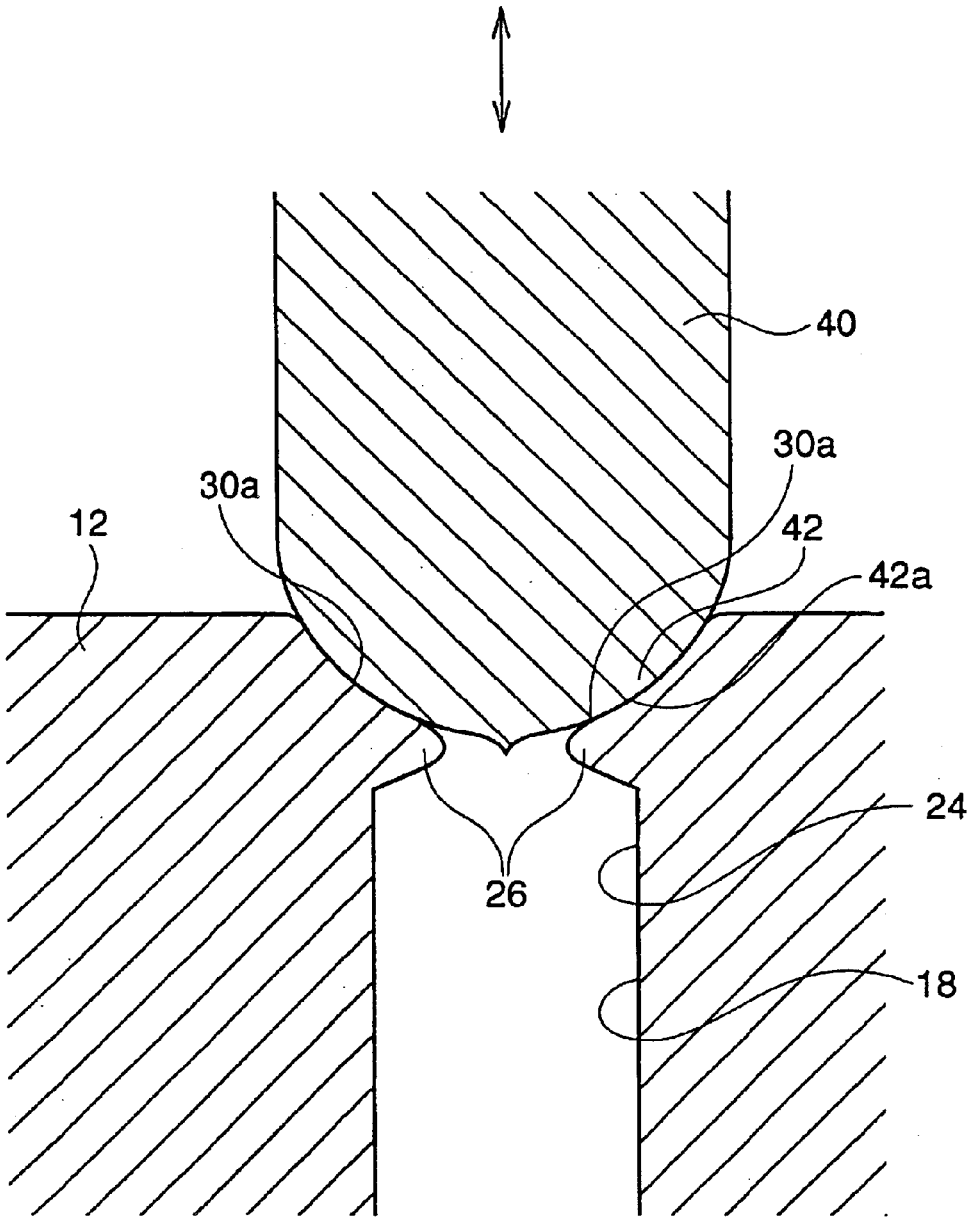
FIG. 10 is a schematic view for explaining a method of manufacturing a piece member according to the second embodiment of the band coupling structure in accordance with the present invention.
Figure 11:
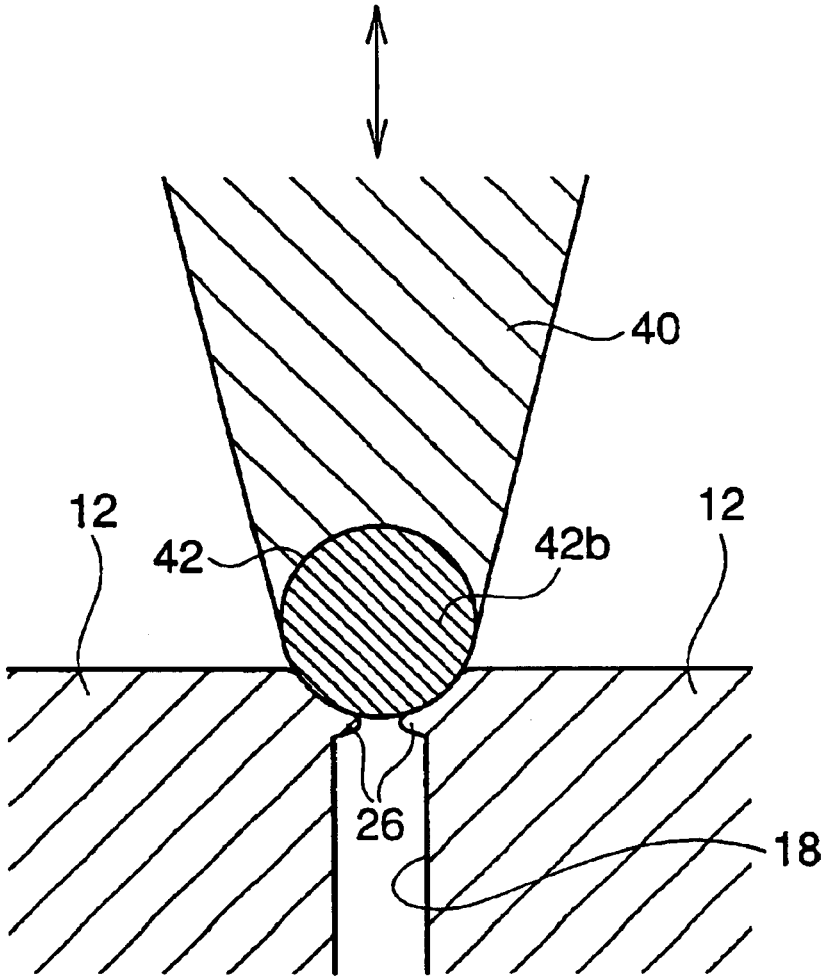
FIG. 11 is a schematic view for explaining the method of manufacturing a piece member according to the second embodiment of the band coupling structure in accordance with the present invention.

FIG. 9 is a sectional view showing a band coupling portion according to a second embodiment of the band coupling structure in accordance with the present invention, and FIGS. 10 and 11 are schematic views for explaining a method of manufacturing a piece member thereof.

Since the band coupling structure according to the present embodiment is basically the same as the band coupling structure according to the first embodiment described above, the same components have the same reference numerals and detailed description thereof will be omitted.

In a band coupling structure 10 according to the embodiment, an outside wall surface 28 of a projection 26 for preventing an adjust pin 22 to be a coupling member from slipping out of coupling holes 18 and 20 is formed to take a curved shape 30*a*. In this case, the curved shape is not particularly restricted but various shapes such as a circular arc, an elliptic arc, a parabola and a hyperbola can be employed.

With such a structure, the projection 26 has the outside wall surface 28 formed to take the curved shape 30*a*. Therefore, the coupling member such as the adjust pin 22 can sufficiently resist the force for slipping outward from the coupling hole 18, and the outside wall surface 28 of the projection 26 which is formed to take the curved shape 30*a* is finely chamfered so that external quality is enhanced decoratively.

As a method of forming the outside wall surface 28 of the projection 26 to take the curved shape 30*a*, the surface of a tip portion 42 of a punch member 40 preferably takes a curved shape 42*a* as shown in FIG. 10 or a ball portion 42*b* is preferably provided in the tip portion 42 of the punch member 40 as shown in FIG. 11.

Figure 12:
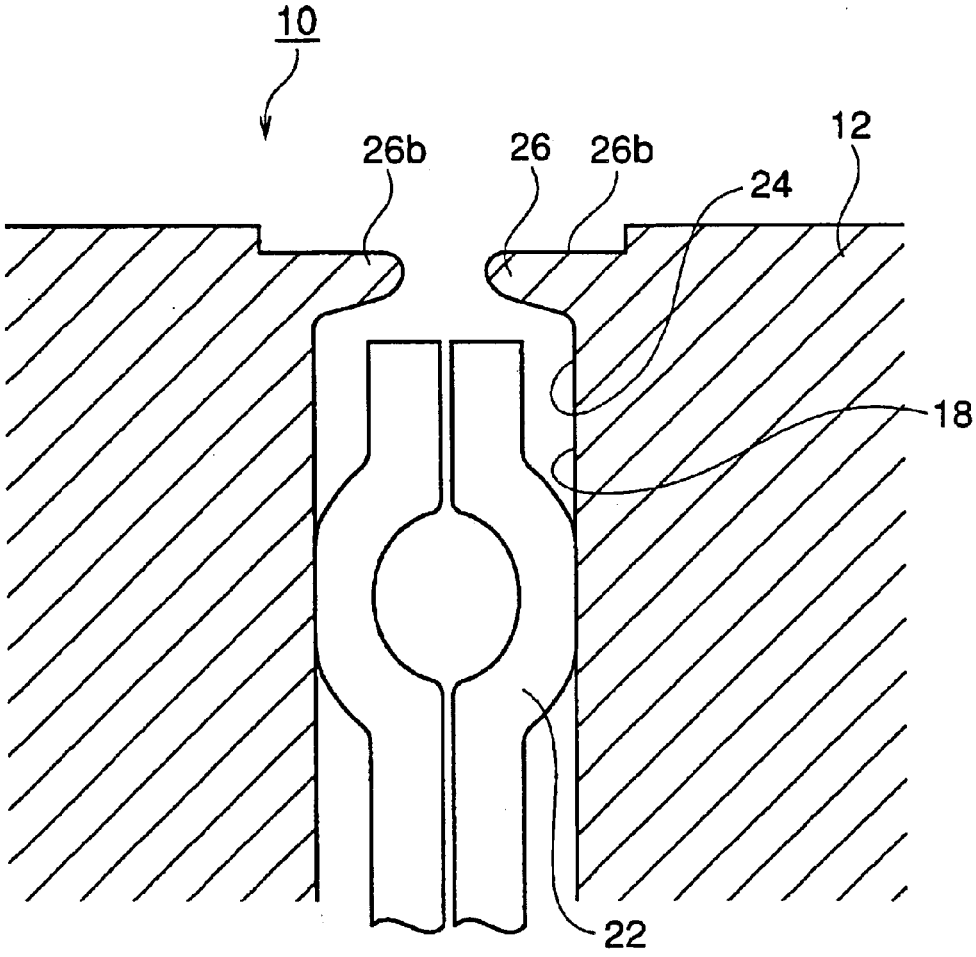
FIG. 12 is a sectional view showing a band coupling portion according to a third embodiment of the band coupling structure in accordance with the present invention.
Figure 13:
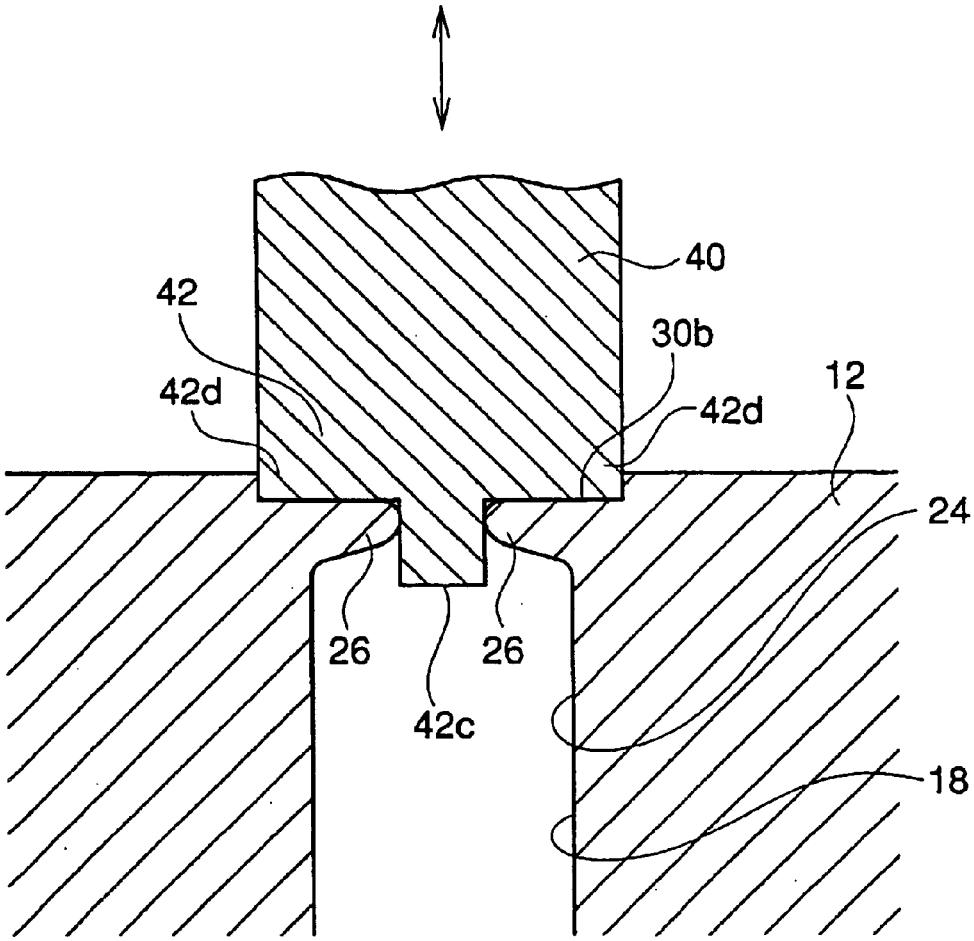
FIG. 13 is a schematic view for explaining a method of manufacturing a piece member according to the third embodiment of the band coupling structure in accordance with the present invention.

FIG. 12 is a sectional view showing a band coupling portion according to a third embodiment of the band coupling structure in accordance with the present invention, and FIG. 13 is a schematic view for explaining a method of manufacturing a piece member thereof.

Since the band coupling structure according to the present embodiment is basically the same as the band coupling structure according to the first embodiment described above, the same components have the same reference numerals and detailed description thereof will be omitted.

In a band coupling structure 10 according to the present embodiment, an outside wall surface 28 of a projection 26 for preventing an adjust pin 22 to be a coupling member from slipping out of coupling holes 18 and 20 is formed to have a perpendicular portion 30*b* to the coupling hole 18.

With such a structure, the projection 26 is formed such that the outside wall surface 28 has a perpendicular portion 26*b* to the coupling hole 18. Therefore, the coupling member such as the adjust pin 22 can sufficiently resist the force for slipping outward from the coupling hole 18. Furthermore, the outside wall surface 28 of the projection 26 formed to have a flat portion 30*b* is finely chamfered so that external quality is enhanced decoratively.

As a method of forming the outside wall surface 28 of the projection 26 to have the perpendicular portion 30*b* to the coupling hole 18, it is preferable that a tip portion 42 of a punch member 40 should be provided with a fitting portion 42*c* for fitting in the coupling hole 18 and a flat portion 42*d* therearound as shown in FIG. 13. It is preferable that the outside diameter of the fitting portion 42*c* should be set in consideration of the inside diameter of the coupling hole 18 according to the projection distance L of the projection 26 described above.

Figure 14:
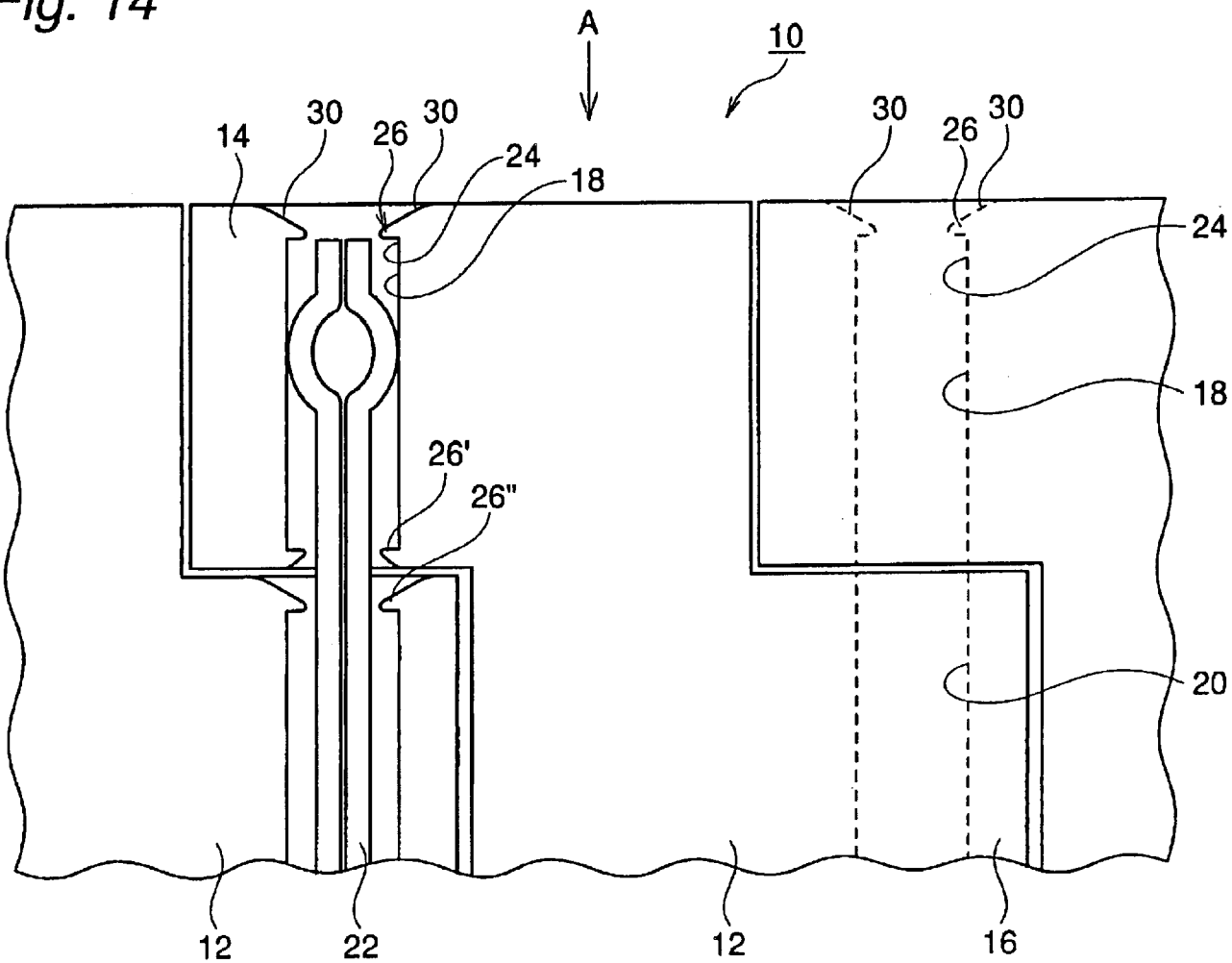
FIG. 14 is a sectional view showing a band coupling portion according to another embodiment of the band coupling structure in accordance with the present invention.
Figure 15:
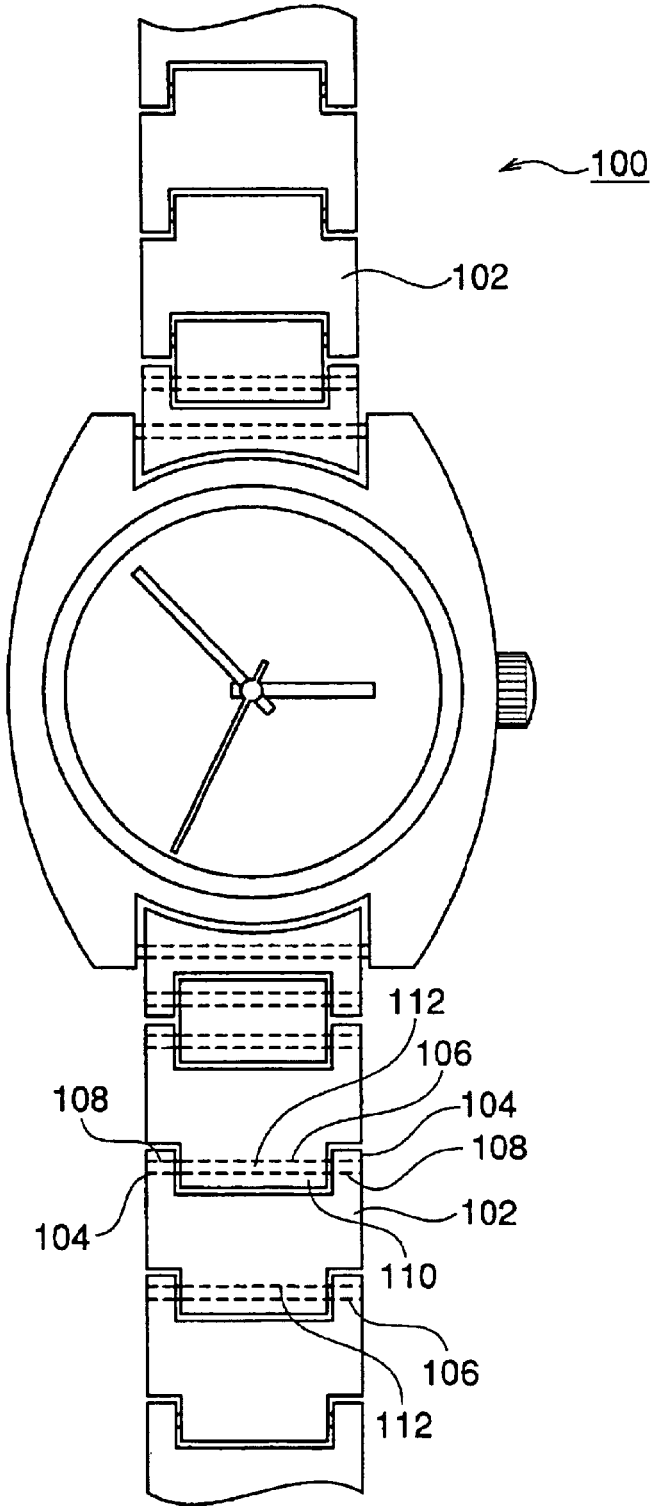
Fig. 15 PRIOR ART
FIG. 15 is a top view showing a band coupling portion in a conventional band coupling structure.
Figure 16:
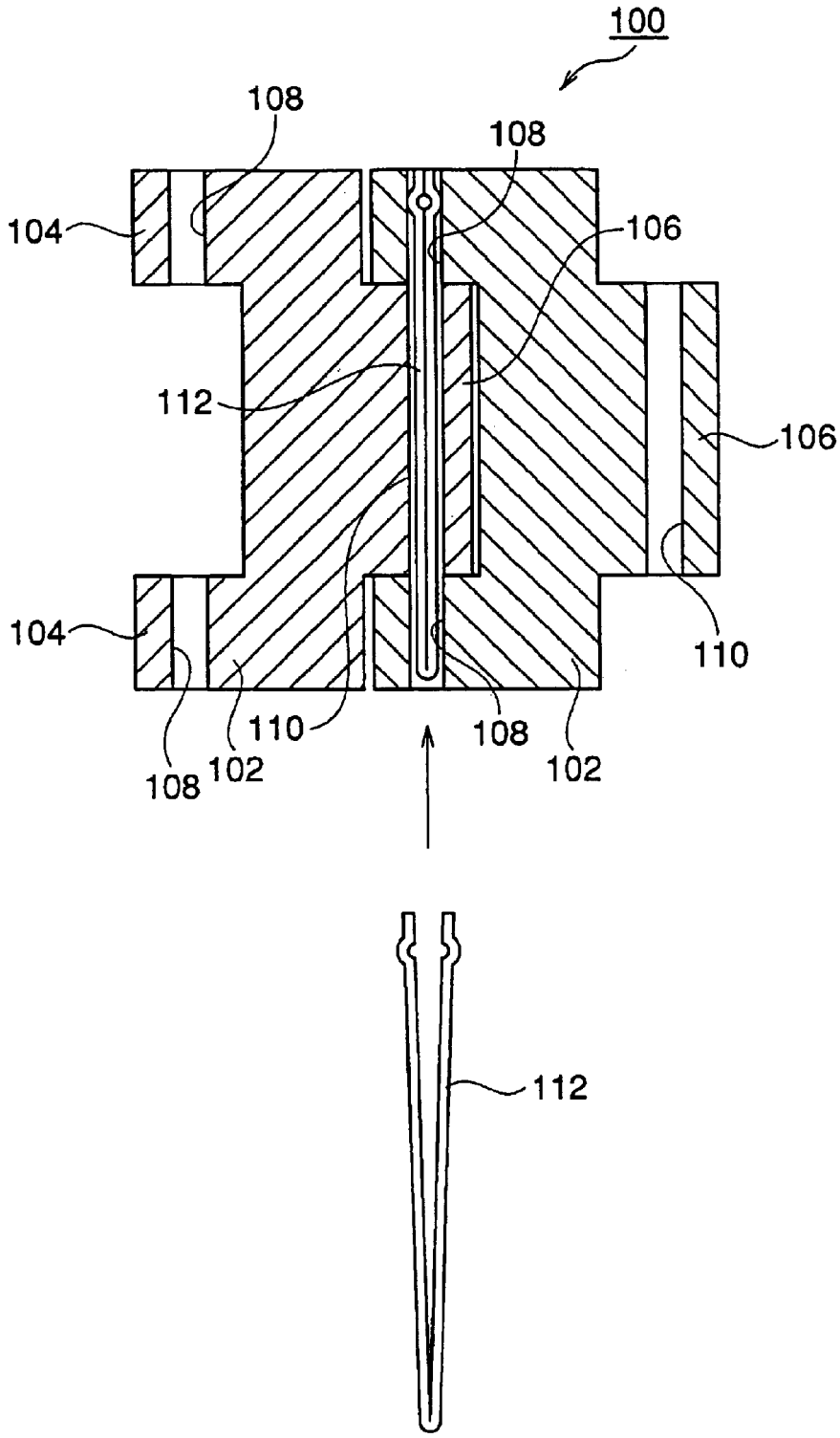
Fig. 16 PRIOR ART
FIG. 16 is a partially enlarged sectional view showing the band coupling portion of the conventional band coupling structure.

FIG. 14 is a sectional view showing a band coupling portion according to another embodiment of the band coupling structure in accordance with the present invention.

Since the band coupling structure according to the present embodiment is basically the same as the band coupling structure according to the first embodiment described above, the same components have the same reference numerals and detailed description thereof will be omitted.

In a band coupling structure 10 according to the present embodiment, a projection 26 is provided on the outer end of a coupling hole 18 in a piece member which is positioned on the outside in a transverse direction in order to prevent an adjust pin 22 to be a coupling member from slipping out of coupling holes 18 and 20. Furthermore, a projection 26' protruded in the central direction of the coupling hole from the internal wall of the coupling hole 18 is formed on the inner end of the coupling hole 18 in a piece member 12 which is positioned on the outside in the transverse direction.

With such a structure, the coupling member is also engaged with the projection 26' formed on the inner end of the coupling hole 18 in the piece member 12 which is positioned on the outside in the transverse direction. Consequently, it is possible to more reliably prevent the coupling member from slipping out of the coupling holes 18 and 20. In addition, a spew generated by forming the coupling hole is absorbed by the formation of the projection 26'. Therefore, the movements of the piece members in the coupling portion are not inhibited.

In the present embodiment, moreover, a projection 26" protruded in the central direction of the coupling hole from the internal wall of the coupling hole 20 is formed on the outer end of the coupling hole 20 in the piece member 12 which is positioned on the inside in the transverse direction.

With such a structure, the coupling member is also engaged with the projection 26" formed on the outer end of the coupling hole 20 in the piece member 12 which is positioned on the inside in the transverse direction. Consequently, it is possible to more reliably prevent the coupling member from slipping out of the coupling holes 18 and 20. In addition, a spew generated by forming the coupling hole is absorbed by the formation of the projection 26". Therefore, the movements of the piece members in the coupling portion are not inhibited.

In this case, it is possible to provide both the projection 26' formed on the inner end of the coupling hole 18 in the piece member 12 which is positioned on the outside in the transverse direction and the projection 26" formed on the outer end of the coupling hole 20 in the piece member 12 which is positioned on the inside in the transverse direction or to provide one of them. Consequently, it is possible to more enhance the effect of preventing the coupling member from slipping off.

While the preferred embodiments of the present invention have been described above, the present invention is not restricted thereto. For example, while the band coupling structure according to the present invention has been applied to the band coupling structure of a watch in the embodiments described above, the band coupling structure can be used for the coupling structures of various bands such as a belt for a bag and a belt for trousers, and various changes can be thus made without departing from the scope of the present invention.

EXAMPLE 1

As shown in FIG. 6, the punch member 40 was pressed against the outer end of the coupling hole 18 positioned on the outside in the transverse direction of the piece member 12 by means of a punch device using a (Ti based) piece member formed of titanium (the coupling hole 18 having a diameter of 990 μmϕ). As a result, the projection 26 protruded in the central direction of the coupling hole 18 from the internal wall 24 of the coupling hole 18 was formed.

The pressing was carried out by the pressing force of the punch member 40 having an impact load of 14 kgf, and the angle β formed by the slant surface 44 of the tip portion 42 of the punch member 40 was changed to 70°, 90°, 100°, 110°, 120°, 130° and 140°. Then, the hole diameter of the coupling hole 18 was measured after processing. A result is shown in the following Table 1.

As is apparent from the result of the Table 1, if the angle β formed by the cone-shaped slant surface 44 is 90° to 130°, the hole diameter is decreased by 17 to 20%. The projection 26 was formed well, particularly at 110°.

TABLE 1

| β | Hole diameter mean value (μm) | Difference 2L from original hole diameter (μm) | Ratio of difference from original hole diameter (%) |
|---|---|---|---|
| 70° | 990 | 0 | 0 |
| 90° | 824 | −166 | −17 |
| 100° | 809 | −181 | −18 |
| 110° | 803 | −187 | −19 |
| 120° | 801 | −189 | −19 |
| 130° | 800 | −190 | −19 |
| 140° | 800 | −190 | −19 |

EXAMPLE 2

In the same manner as in the example 1, the projection 26 was formed. The angle β formed by the slant surface 44 of the tip portion 42 of the punch member 40 was set to 110° and a (SUS 304 based or 316 based) piece member formed of stainless (the coupling hole 18 having a diameter of 990 μmϕ) was used in place of the (Ti based) piece member (the coupling hole 18 having a diameter of 990 μmϕ) formed of titanium. Moreover, the pressing force of the punch member 40 was changed to have an impact load of 4 kgf, 5 kgf, 6 kgf, 7 kgf, 8 kgf, 9 kgf, 10 kgf, 11 kgf, 12 kgf, 13 kgf, 14 kgf and 15 kgf.

The hole diameter of the coupling hole 18 after the processing and the projection distance L were measured. A result is shown in the following Table 2.

As is apparent from the result of the Table 2, the pressing was carried out by the processing force of the punch member 40 having an impact load of 5 kgf to 14 kgf. Consequently, the projection 26 was formed well, particularly at an impact load of 8 kgf. There was no influence by the quality of the material of the piece member.

While the pressing force of the punch member 40 is indicated as the impact load in the Table 2, the pressing force indicated as the impact load is approximately 20 times as much as a static load based on a conversion. For example, in the case in which an autopunch is used and an impact load is set to 5 kgf, a static load of approximately 100 kgf was obtained based on the conversion.

TABLE 2

| Pressing | Hole diameter mean value (μm) | | Projection distance 2L (μm) | |
|---|---|---|---|---|
| force | Titanium | Stainless | Titanium | Stainless |
| 4 kgf | 970 | 980 | −20 | −10 |
| 5 kgf | 951 | 970 | −39 | −20 |
| 6 kgf | 937 | 955 | −53 | −35 |
| 7 kgf | 920 | 939 | −70 | −51 |
| 8 kgf | 901 | 907 | −89 | −83 |
| 9 kgf | 885 | 891 | −105 | −99 |
| 10 kgf | 868 | 886 | −122 | −104 |
| 11 kgf | 845 | 872 | −145 | −118 |
| 12 kgf | 825 | 859 | −165 | −131 |
| 13 kgf | 813 | 848 | −177 | −142 |

TABLE 2-continued

| Pressing force | Hole diameter mean value (μm) | | Projection distance 2L (μm) | |
|---|---|---|---|---|
| | Titanium | Stainless | Titanium | Stainless |
| 14 kgf | 803 | 838 | −187 | −152 |
| 15 kgf | 788 | 818 | −202 | −172 |

EXAMPLE 3

A hair pin was inserted as a coupling member in the piece member and a band coupling structure was thus assembled, and the projection 26 was then formed in the same manner as in the example 1. The angle β formed by the slant surface 44 of the tip portion 42 of the punch member 40 was set to 110° and the pressing force of the punch member 40 was set to have an impact load of 8 kgf.

After the processing, antislipping force was measured. As a comparison, an antislipping force test was also executed for a band coupling structure assembled by using an unprocessed piece member. A result is shown in the following Table 3.

As is apparent from the result of the Table 3, the piece member fabricated according to the present invention had considerably great antislipping force and a more excellent effect of preventing the coupling member from slipping off as compared with the conventional unprocessed piece member.

TABLE 3

| β | Antislipping force mean value (kg/cm$^2$) | |
|---|---|---|
| | Prior art | Invention |
| 110° | 3.04 | 7.89 |

According to the present invention, the projection protruded in the central direction of the coupling hole from the internal wall of the coupling hole is formed on the outer end of the coupling hole of the piece member positioned on the outside in the transverse direction. Therefore, when the coupling member is inserted and attached into the coupling hole, the coupling member is engaged with the projection. Consequently, it is possible to reliably prevent the coupling member from slipping out of the coupling hole. In addition, a spew generated by forming the coupling hole is absorbed by the formation of the projection. Consequently, external quality can be enhanced.

In the present invention, moreover, the projection has an outside wall surface formed to have the taper surface inclined toward the inner central part of the coupling hole. Therefore, the coupling member can sufficiently resist the force for slipping outward from the coupling hole, and furthermore, the inclined taper surface is chamfered so that the external quality can be enhanced decoratively.

Furthermore, in the present invention, the projection has an outside wall surface formed to take a curved shape. Therefore, the coupling member can sufficiently resist the force for slipping outward from the coupling hole, and furthermore, the outside wall surface of the projection formed to take the curved shape is finely chamfered so that the external quality can be enhanced decoratively.

Moreover, in the present invention, the projection has an outside wall surface formed to be perpendicular to the coupling hole. Consequently, the coupling member can sufficiently resist the force for slipping outward from the coupling hole, and furthermore, the outside wall surface of the projection which is formed flatly is finely chamfered so that the external quality can be enhanced decoratively.

Furthermore, in the present invention, the surface of the tip portion of the punch member has at least one finished face selected from a mirror finished surface, a hairline, a matte finished surface and a concavo-convex pattern. Such a punch member is simply pressed against the outer end of the coupling hole so that the finished face of the surface of the tip portion of the punch member can easily be transferred onto the outside wall surface of the projection.

Accordingly, the outside wall surface of the projection can be formed to have at least one finished face selected from the mirror finished surface, the hairline, the matte finished surface and the concavo-convex pattern. Therefore, the taper surface can be finely chamfered. Thus, it is possible to provide a band coupling structure in which external quality can be enhanced decoratively and a high-class impression can be given Thus, the invention is very excellent because many functions and effects can be produced.

What is claimed is:

1. A coupling structure for a band comprising:

a plurality of piece members wherein each piece member comprises a generally U-shaped configuration having a pair of spaced-apart protruding coupling members at one end and a centrally located coupling projection at an opposite end, wherein said spaced-apart coupling members are adapted to receive the central coupling projection of an adjacent piece member therebetween when adjacent piece members are mated together;

each of said spaced-apart protruding coupling members and said central coupling projections having coupling holes formed therethrough in a direction transverse to the piece member wherein the coupling holes of the spaced-apart protruding coupling members and the coupling hole of the central coupling projection of an adjacent piece member are coaxially aligned when adjacent piece members are mated together;

at least one projection formed in an internal wall of the coupling hole in said spaced-apart protruding coupling members by pressing in a direction coaxial with the coupling hole, said projection extending in a direction transverse to the axis of the coupling hole and positioned at an outer end of said coupling hole; and an elongated coupling member inserted in the coupling holes of the spaced-apart protruding coupling members and the coupling hole of the central coupling projection of an adjacent piece member, whereby said elongated coupling member is engaged by said projection so that adjacent piece members are coupled to each other.

2. The band coupling structure of claim 1, wherein a second projection is formed in the coupling hole in said spaced-apart protruding coupling members and positioned at an inner end of the coupling hole facing the central coupling projection of an adjacent piece member.

3. The band coupling structure of claim 1, wherein a projection is formed in the coupling hole of the central coupling projection of the piece member, wherein said projection is positioned at an outer end of said coupling hole facing one of the spaced-apart protruding coupling members of an adjacent piece member.

4. The band coupling structure of claim 1, wherein the projection is formed over a whole periphery of the internal wall of the coupling hole.

5. The band coupling structure of claim 1, wherein the projection is partially formed on the internal wall of the coupling hole.

6. The band coupling structure of claim 1, wherein two projections are formed in the coupling hole of the spaced-apart protruding coupling members, each projection positioned at an opposed outer end of said coupling hole.

7. The band coupling structure of claim 1, wherein the projection has an outside wall surface formed to have a taper surface inclined toward an inner central part of the coupling hole.

8. The band coupling structure of claim 7, wherein a crossing angle $\alpha$ formed by the taper surface of the projection is set to range from 90° to 130°.

9. The band coupling structure of claim 8, wherein the crossing angle $\alpha$ formed by the taper surface of the projection is at least one selected from 90°, 100°, 110°, 120° and 130°.

10. The band coupling structure of claim 7, wherein the projection is formed by pressing a punch member against the outer end of the coupling hole having an impact load of approximately 8 kgf at a crossing angle $\alpha$ formed by the taper surface of the projection of approximately 110°.

11. The band coupling structure of claim 1, wherein the projection has an outside wall surface formed to take a curved shape.

12. The band coupling structure of claim 1, wherein the projection has an outside wall surface formed to be perpendicular to the coupling hole.

13. The band coupling structure of claim 1, wherein the projection is formed by pressing a punch member against the outer end of the coupling hole having an impact load of 5 kgf to 14 kgf.

14. The band coupling structure of claim 13, wherein the projection is formed by pressing the punch member having an impact load selected from 5 kgf, 6 kgf, 7 kgf, 8 kgf, 9 kgf, 10 kgf, 11 kgf, 12 kgf, 13 kgf and 14 kgf.

15. The band coupling structure of claim 13, wherein a surface of a tip portion of the punch member has at least one finished face selected from a mirror finished surface, a hairline, a matte finished surface and a concavo-convex pattern, and the finished face of the surface of the tip portion of the punch member is thereby transferred onto the outside wall surface of the projection so that the outside wall surface of the projection has at least one finished face selected from the mirror finished surface, the hairline, the matte finished surface and the concavo-convex pattern.

16. The band coupling structure of claim 1, wherein the projection is formed by pressing a punch member against the outer end of the coupling hole having an impact load of approximately 8 kgf.

17. The band coupling structure of claim 1, wherein the coupling member is a coupling pin or an adjust pin.

18. The band coupling structure of claim 17, wherein the coupling pin is at least one selected from a press-in pin, a hair pin and a pin and split pipe.

19. The band coupling structure of claim 17, wherein the adjust pin is at least one selected from a hair pin and a pin and split pipe.

20. A method of manufacturing a piece member to be used for a coupling structure of a band comprising a plurality of piece members as set forth in claim 1, wherein a punch member is pressed against an outer end of the coupling hole in the piece member in a direction coaxial with the coupling hole, thereby forming a projection extending from the internal wall of the coupling hole in a direction transverse to the axis of the coupling hole.

21. The method of manufacturing a piece member of claim 20, wherein the projection is positioned at an outside end of the coupling hole.

22. The method of manufacturing a piece member of claim 20, wherein the projection is formed over a whole periphery of the internal wall of the coupling hole.

23. The method of manufacturing a piece member of claim 20, wherein the projection is partially formed on the internal wall of the coupling hole.

24. The method of manufacturing a piece member of claim 20, wherein the projection is formed on opposed outer ends of the coupling hole.

25. The method of manufacturing a piece member of claim 20, wherein a tip portion of the punch member is cone-shaped so that the projection has an outside wall surface formed to have a taper surface inclined toward an inner central part of the coupling hole.

26. The method of manufacturing a piece member of claim 25, wherein a crossing angle $\alpha$ formed by the taper surface of the projection is set to range from 90° to 130°.

27. The method of manufacturing a piece member of claim 26, wherein the crossing angle $\alpha$ formed by the taper surface of the projection is at least one selected from 90°, 100°, 110°, 120° and 130°.

28. The method of manufacturing a piece member of claim 25, wherein the projection is formed by pressing the punch member against the outer end of the coupling hole having an impact load of approximately 8 kgf at a crossing angle $\alpha$ formed by the taper surface of the projection of approximately 110°.

29. The method of manufacturing a piece member of claim 20, wherein a tip portion of the punch member is curve-shaped so that the projection has an outside wall surface formed to take a curved shape.

30. The method of manufacturing a piece member of claim 20, wherein a tip portion of the punch member includes a fitting portion for fitting in the coupling hole and a flat portion therearound so that the projection has an outside wall surface formed to be perpendicular to the coupling hole.

31. The method of manufacturing a piece member of claim 20, wherein the projection is formed by pressing a punch member against the outer end of the coupling hole having an impact load of 5 kgf to 14 kgf.

32. The method of manufacturing a piece member of claim 31, wherein the projection is formed by pressing the punch member having an impact load selected from 5 kgf, 6 kgf, 7 kgf, 8 kgf, 9 kgf, 10 kgf, 11 kgf, 12 kgf, 13 kgf and 14 kgf.

33. The method of manufacturing a piece member of claim 31, wherein a surface of a tip portion of the punch member has at least one finished face selected from a mirror finished surface, a hairline, a matte finished surface and a concavo-convex pattern, and the finished face of the surface of the tip portion of the punch member is thereby transferred onto the outside wall surface of the projection so that the outside wall surface of the projection has at least one finished face selected from the mirror finished surface, the hairline, the matte finished surface and the concavo-convex pattern.

34. The method of manufacturing a piece member of claim 20, wherein the projection is formed by pressing the punch member against the outer end of the coupling hole having an impact load of approximately 8 kgf.

* * * * *

UNITED STATES PATENT AND TRADEMARK OFFICE

CERTIFICATE OF CORRECTION

PATENT NO. : 6,913,411 B2
DATED : July 5, 2005
INVENTOR(S) : Yamakawa et al.

It is certified that error appears in the above-identified patent and that said Letters Patent is hereby corrected as shown below:

Title page,
Item [57], ABSTRACT,
Line 2, “does not sup” should read -- does not slip --.

Signed and Sealed this

Tenth Day of January, 2006

JON W. DUDAS
*Director of the United States Patent and Trademark Office*